US005450890A

United States Patent [19]

Pinkalla et al.

[11] Patent Number: 5,450,890

[45] Date of Patent: Sep. 19, 1995

[54] ROLL-UP STRIP CURTAIN BARRIER APPARATUS

[75] Inventors: Cary Pinkalla, Fox Point, Wis.; Garrett Goins, Dubuque, Iowa

[73] Assignee: Rite-Hite Corporation, Milwaukee, Wis.

[21] Appl. No.: 130,590

[22] Filed: Oct. 1, 1993

[51] Int. Cl.[6] ..... E06B 9/08

[52] U.S. Cl. ..... 160/121.1; 160/133; 160/310

[58] Field of Search ..... 160/133, 310, 332, 127, 160/25, 121.1, 238, 263, 237, 383, 23.1

[56] References Cited

U.S. PATENT DOCUMENTS

| | | | |
|---|---|---|---|
| 1,622,245 | 3/1927 | Bliss | 160/121.1 X |
| 1,649,943 | 11/1927 | Boeck | 160/121.1 |
| 2,041,258 | 5/1936 | Mitchell | 160/121.1 |
| 2,247,306 | 6/1941 | Partridge | 156/39 |
| 2,335,274 | 11/1943 | Hampton . | |
| 2,572,257 | 10/1951 | Gerner et al. | 160/133 X |
| 3,249,150 | 5/1966 | Knight | 160/332 X |
| 3,331,425 | 7/1967 | Groves et al. . | |
| 3,421,568 | 1/1969 | Youngs | 160/310 |
| 3,538,655 | 11/1970 | Frommelt et al. . | |
| 3,583,465 | 6/1971 | Youngs et al. | 160/310 X |
| 3,809,144 | 5/1974 | Garufo . | |
| 3,826,049 | 7/1974 | Frommelt et al. . | |
| 3,960,216 | 6/1976 | Isobe . | |
| 4,085,789 | 4/1978 | Steiner et al. . | |
| 4,232,725 | 11/1980 | Gridge | 160/332 |
| 4,326,577 | 4/1982 | Tse | 160/259 |
| 4,384,606 | 5/1983 | Johnston et al. | 160/332 |
| 4,676,293 | 6/1987 | Hanssen . | |
| 4,794,971 | 1/1989 | Lohausen | 160/133 X |
| 4,800,946 | 1/1989 | Rosenoy . | |
| 4,842,035 | 6/1989 | Thompson . | |
| 4,887,659 | 12/1989 | West . | |
| 4,887,660 | 12/1989 | Kraus . | |
| 4,953,608 | 9/1990 | Larsson | 160/133 X |
| 4,974,658 | 12/1990 | Komatsu et al. | 160/133 X |
| 5,025,846 | 6/1991 | West . | |
| 5,143,137 | 9/1992 | West . | |
| 5,203,395 | 4/1993 | Koller et al. | 160/121.1 X |

FOREIGN PATENT DOCUMENTS

| | | |
|---|---|---|
| 521521 | 7/1921 | France . |

*Primary Examiner*—David M. Purol

*Attorney, Agent, or Firm*—Leydig, Voit & Mayer, Ltd.

[57] ABSTRACT

A roll-up strip curtain barrier apparatus is provided which provides a curtain member suspended from a support roller rotatably mounted about a door opening. The curtain member has plurality of flexible curtain-like strip panels which are adapted to span the door opening and provide an air-blocking seal. In one embodiment, the plurality of the strip panels are disposed in a plurality of rows, each row having a plurality of adjacent strip panels. The panels in one row are in abutting and overlapping relationship with the panels in the adjacent row. In one mode of operation, the flexible strip panels deflect in response to personnel and material passing through the door opening and then return to their original suspended position. In another mode of operation, the support roller may be rotated so as to wind and elevate the curtain member about the roller and create an unobstructed door opening. Reverse rotation of the support roller lowers the curtain member to the sealing position. In one embodiment, the sides of the individual strip panels taper and narrow inwardly from the top to the bottom side so that the tapered sides of adjacent strip panels form gaps therebetween. The strip panels in the adjacent row are disposed in abutting and overlapping relationship with the strip panels in the first row to cover the gaps.

34 Claims, 4 Drawing Sheets

ROLL-UP STRIP CURTAIN BARRIER APPARATUS

FIELD OF THE INVENTION

The present invention relates generally to an apparatus for providing a barrier across a door opening, a room or other space and, more particularly, to an apparatus having a roll-up strip curtain.

BACKGROUND OF THE INVENTION

Many industrial and retail buildings will typically have doorways or large rooms that must be open for extended periods of time for ingress and egress of personnel and material. Since the open doorway and the rooms may be quite large, making it extremely difficult to control the interior temperature within the room or building, it is desirable to create an air-blocking barrier. In other applications, it may be desirable to partition the large rooms or spaces into smaller sections, for example, in order to separate work cells or assembly lines or prevent debris and the like from leaving the space. Attempts to control the passage of conditioned air through door openings and within the large spaces or to partition large rooms have included power roll-up doors and strip curtain doors.

Conventional strip curtains consist of a plurality of strips of overlapping and abutting curtain-like material, typically made of plastic, vinyl, fabric or the like, which create a flexible barrier across the doorway and/or space. To create an air-blocking seal, the strips may be hung so as to span substantially the entire doorway or space, typically from the floor to the top of the doorway or ceiling. The strips may also be disposed in the space so as to partition the space without creating an air blocking seal. The individual strips deflect to allow passage of personnel and material through the barrier. A perceived disadvantage of such strip curtains is that the strips brush against the personnel, product or material as they pass through the barrier. This contact may be irritating to personnel and, in the case of certain products, such as food or delicate products, such contact may cause damage, infection or other harm as the material passes through the barrier.

Conventional roll-up doors typically consist of a solid flexible curtain or barrier, typically made of plastic, vinyl, fabric or the like, which fully covers the door opening. The curtain is attached to a power roller or drum at the top of the opening which rotates so as to raise and lower the curtain. Unfortunately, the power roll-up doors are expensive and require complicated actuation and other assemblies such as high speed motors, break-away bars, belting mechanisms and the like to operate efficiently. The power roll-up doors also require complicated safety devices in the event that the door does not properly or completely open when personnel and material pass through it.

OBJECTS AND SUMMARY OF THE INVENTION

Accordingly, it is an object of the present invention to provide a curtain barrier apparatus which is not beset with any of the aforementioned shortcomings.

It is an object of the present invention to provide an improved barrier apparatus which may provide an air-blocking seal across a door opening or partition a room or other space.

It is a specific object of the present invention to provide an improved curtain barrier apparatus which may be selectively adjusted or removed to prevent contact with personnel or material passing through the barrier. Another object is to provide a barrier apparatus having detachable and replaceable parts.

It is another object of the present invention to provide a curtain barrier apparatus which functions in an efficient and practical manner, is easily and economically manufactured and assembled and is adapted for operation with doors or spaces of various widths and heights.

A curtain barrier apparatus is provided comprising a curtain member suspended from a support roller or drum disposed about a door opening. The curtain member has a plurality of flexible curtain-like strip panels which are adapted to span the door opening and provide an air-blocking seal. The strip panels are disposed in an overlapping and abutting relationship adapted to form the air-blocking seal. In one embodiment, the strip panels are disposed in a plurality of rows so that the panels in one row are in abutting and overlapping relationship with the panels in the adjacent row. In one mode of operation, the flexible strip panels deflect in response to personnel and material passing through the door opening and then return to their original suspended position. In another mode of operation, the support roller may be rotated so as to wind and elevate the curtain member about the roller and create an unobstructed door opening. Reverse rotation of the support roller lowers the curtain member to the sealing position.

The width of the individual strip panels may narrow or taper from the top to the bottom side to prevent entanglement of strips about the roller. The curtain member may have a plurality of adjacent and overlapping rows, each row containing a plurality of strip panels which are disposed adjacent to each other and wherein the tapered sides of adjacent strip panels form gaps therebetween. The strip panels in one row are disposed in abutting and overlapping relationship with the strip panels in an adjacent row to cover the gaps.

The strips panels may be attached directly to the support roller, or the curtain member may comprise an upper rectangular panel which spans the upper portion of the door opening wherein one end of the upper panel is attached to the support roller and the other end is attach to and supports the strip panels. It is preferred that the curtain member be releasably attached to the support roller using a suitable method such as a hook and loop fastener. Similarly, the individual strip panels may be releasably attached to the upper panel or the support roller using a hook and loop fastener.

It will be appreciated that the barrier apparatus may also be used to partition a room or other space by disposing the support roller across the room. In such an application, the curtain barrier may be sized to create the desired barrier and does not necessarily have to create an air-blocking seal.

These and other features and advantages of the invention will be more readily apparent upon reading the following description of preferred exemplified embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
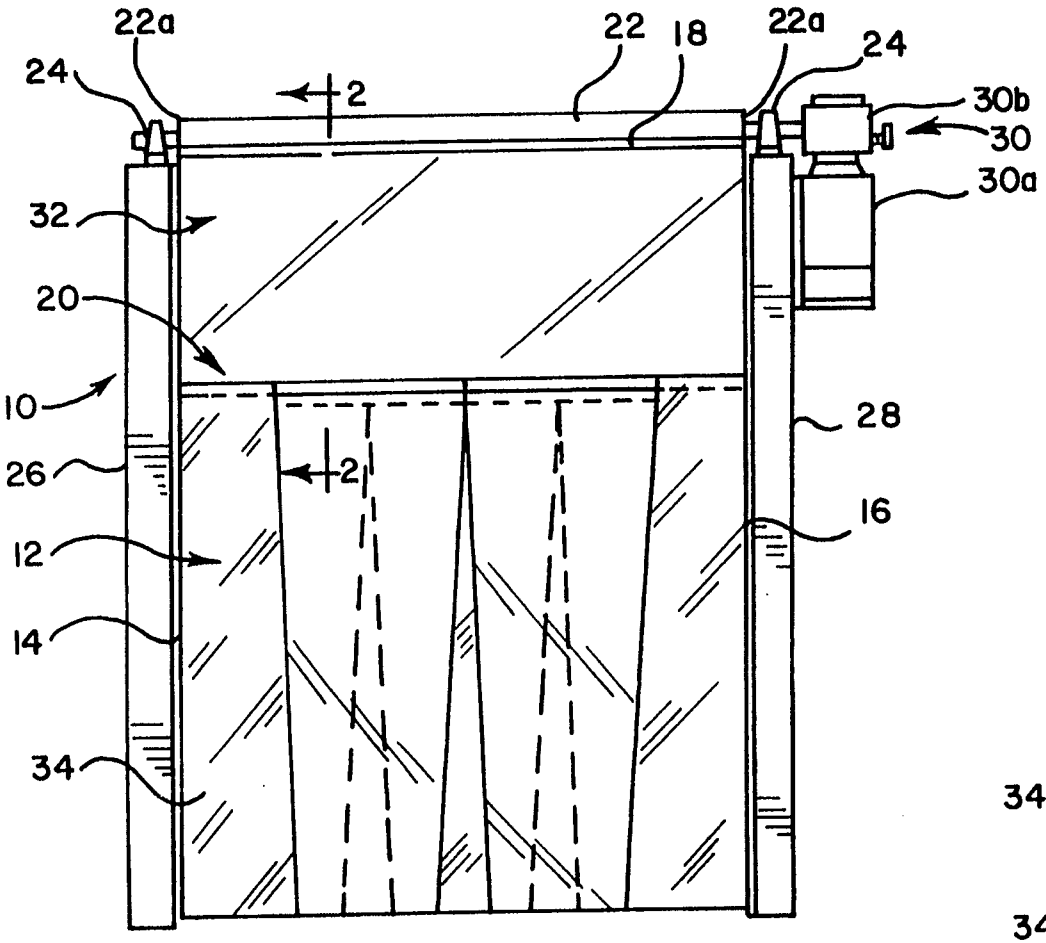
FIG. 1 is a front view of one embodiment of the curtain barrier apparatus in accordance with the present invention and showing a curtain member in a closed, sealing position.

Referring to the figures and more particularly to FIG. 1, one embodiment of a roll-up strip curtain barrier apparatus 10 in accordance with the present invention is illustrated. In the following discussion, the structure and operation of the curtain barrier 10 will be described in connection with a door opening generally depicted as 12 although it will be appreciated that the curtain barrier 10 may also utilized to create a barrier which partitions a room or space.

The roll-up strip curtain barrier apparatus 10 is mounted across a typical door opening 12 or a room or other space to create a barrier through which personnel and material may pass. The door opening 12 is defined by opposing left and right sides (as viewed in the figures) and a top side generally depicted as 14, 16, 18, respectively.

The curtain barrier apparatus 10 comprises a curtain member 20 which spans the door opening 12 and is attached to a support roller 22 so that it provides an air-blocking seal across the door opening 12. The support roller 22 is rotatably mounted substantially horizontally in, above, or at the top side 18 of the door opening 12 so that the rotation of the support roller 22 positions the curtain member 20 between a sealing position illustrated in FIGS. 1 and 3 and an open position. Rotation of the roller 22 in one direction will wind the curtain member 20 about the roller 22 and cause the curtain member 20 to elevate to the raised or open position wherein the door opening 12 is unobstructed. Reverse rotation of the support roller 22 causes the curtain member 20 to unwind and, in accordance with certain objects of the invention, form an air-blocking seal adapted to prevent or minimize the passage of air across the door opening 12 in the closed or lowered position.

The opposite ends 22*a* of the support roller 22 are rotatably supported by bearing members 24 on the upper ends of left and right side frames 26, 28 which extend upwardly from a support surface as viewed from the front. The support roller 22 is operatively connected to a motor assembly 30 which is also supported by the side frame 28. It will be appreciated that the support roller 22 and motor assembly 30 may also be mounted directly to the wall. The motor assembly 30 will typically comprise an appropriate gear box and an electrically driven motor (not shown) adapted to rotate the support roller 22 at the appropriate speeds so as to control the winding and unwinding of the curtain member 20. It will also be appreciated that the support roller 22 may also be manually operated using a conventional chain, rope or cable system (not shown) or the like. In the illustrated embodiment, the frames 26, 28 are disposed about a door opening but they may also be disposed in a room so as to support the curtain member and create a barrier which partitions the room.

In order to create an air-blocking seal across the door opening 12 or other space, the support roller 22, the frames 26, 28 and the curtain member 20 should be sized so as to substantially span the entire door opening 12. In order to partition a room or other space, it is not necessary that the curtain member 22 create an air-blocking seal, only that it create an appropriately sized barrier through which personnel and material may pass.

The curtain member 20 is flexible so that it may be rolled about the support roller 22 between the sealing position and the open position. In the embodiment illustrated in FIGS. 1, 2 and 5, the curtain member 20 comprises a relatively large, rectangular, upper main body panel 32 and a lower pass-through portion comprising a plurality of smaller, lower strip panels 34. The upper panel 32 is of sufficient width and height to span and seal across the upper portion of the door opening 12. The upper panel 32 has a top side 32*a* which is adapted to be attached to the support roller 22 and a bottom side 32*b* which is adapted to attach to and support the lower strip panels 34.

The lower strip panels 34 are suspended from the upper curtain panel 32 so that strip panels 34 form an air-blocking seal across the lower portion of the door opening. In accordance with certain objects of the invention, the lower strip panels 34 are flexible and deflect so as to permit personnel and material to pass therethrough. After the personnel or material pass through the strip panels 34, the individual panels 34 reassume their original position and form the air-blocking seal.

Each individual panel 34 may have any physical configuration which forms the proper seal, permits personnel and material to pass through, and permits the curtain member 20 to be wound about the support roller 22. In the embodiments illustrated in FIGS. 1, 3, and 5, the lower strip panels 34 have end strip panels 34*a* and middle strip panels 34*b*. In the middle strip panel 34*b*, both sides of the panel 34*b* narrow and taper inwardly and downwardly from the top side to the bottom side. In the end panels 34*a*, the exterior side is generally straight and adjacent the door side 14 or 16 and the interior side tapers inwardly and downwardly. It has been found that the taper permits the lower strip panels 34 to wind about the support roller 22 without entanglement or "bunching" between adjacent panels 34. It will be appreciated that lower strip panels 34 may also have parallel opposing sides or the side may taper outwardly from the top to the bottom sides, although, in these configurations, the sides may have a tendency to become entangled.

Figure 5:
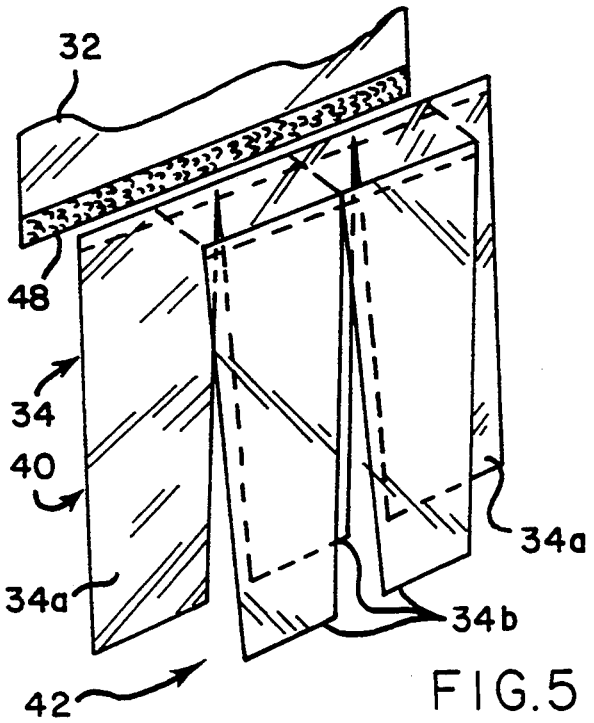
FIG. 5 is an exploded view illustrating the mounting of the strip panels in FIGS. 1.
Figure 6:
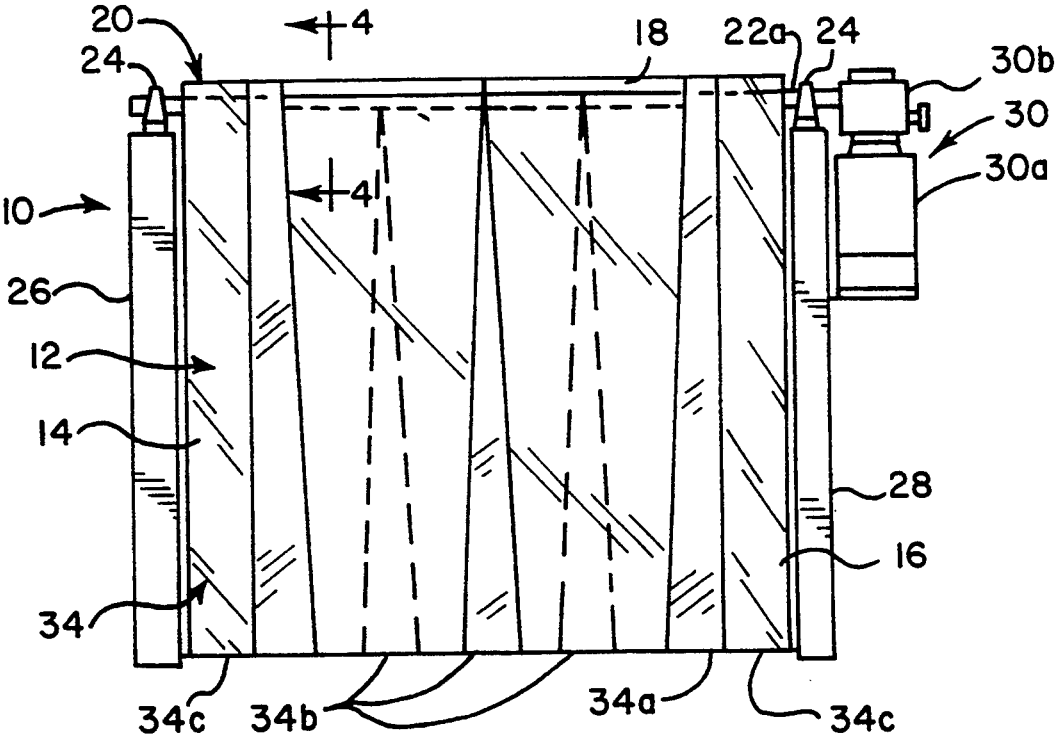
FIG. 6 is a front view of a third embodiment of the curtain barrier apparatus in accordance with the present invention.
Figure 7:
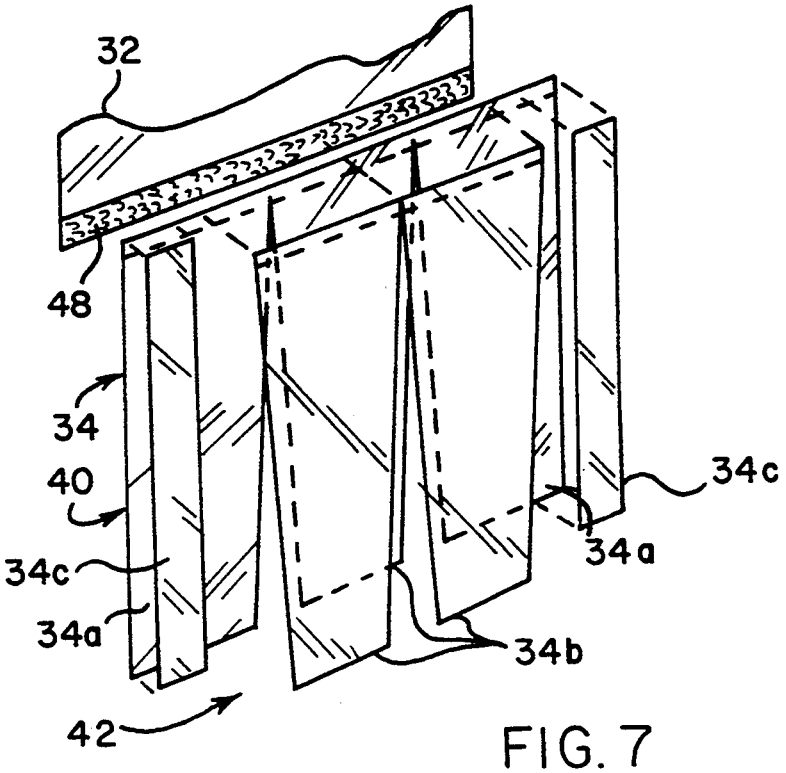
FIG. 7 is an exploded view illustrating the mounting of the strip panels in FIG. 6.
Figure 8:
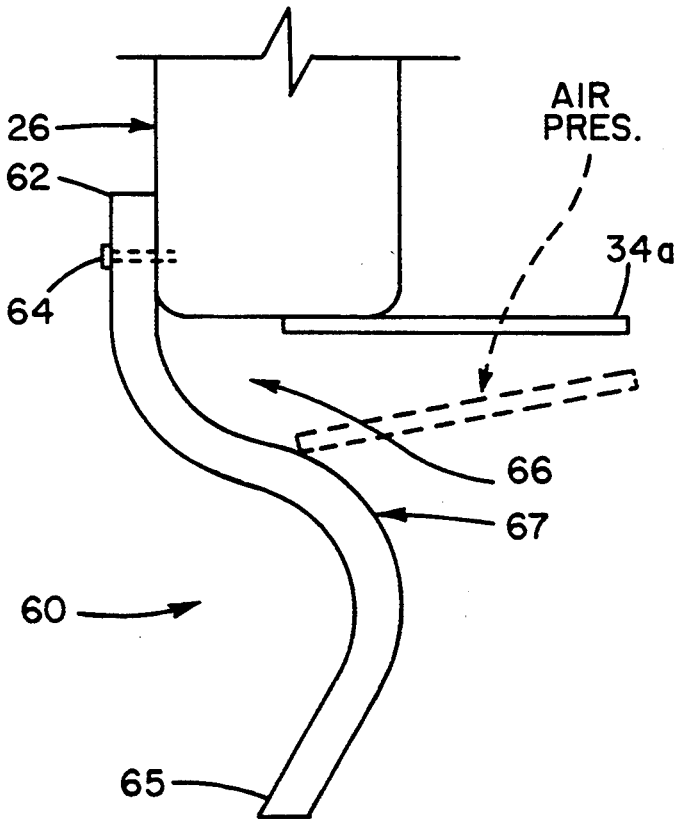

The size, configuration, and number of the strip panels 34 may be varied and will depend, in part, on the size of the door opening 12 and the type and weight of the panel material. In the embodiment illustrated in FIGS. 1, 3, and 5, the lower portion of the curtain member 20 has five strip panels 34 although any number of panels may be utilized. Referring to FIGS. 1 and 5, it will be seen that the five strip panels 34 form rear and front rows, each row formed of adjacent but not overlapping strip panels 34. The panels 34 forming one row overlap and abut against the panels 34 forming the adjacent row. The rear row generally depicted as 40 comprises a middle strip panel **34*b* between two end panels 34*a*. It will be appreciated that two gaps are formed by the tapering sides between the adjacent strip panels 34. The front row generally depicted as 42 comprises two middle curtain members 34*b* which overlap and abut the panels 34 forming the rear row 40 so as to cover and seal the gaps and create an air-blocking barrier. Although an air-blocking barrier is created, the individual strip panels 34 remain flexible and movable so that personnel and material may pass therethrough. Referring to FIGS. 6 and 7, it will be seen that additional strip panels 34*c* are disposed so that they overlap the end strip panel 34*a* so as to provide additional support and rigidity to the end panel 34*a***.

The curtain member 20 may be fabricated from any appropriate material such as plastic, vinyl, fabric or other similar material. It may also be desirable for the curtain member 20 to be fabricated from an appropriate material which filters ultraviolet light if the curtain member is utilized in connection with welding applications or disposed in strong sunlight. It has been found that curtain member fabricated from clear PVC material having a thickness from about 0.04 to about 0.16 inches is suitable for many applications, although thicker materials are certainly appropriate.

For illustrative purposes only, in a typical door measuring about 10 feet by 10 feet, the upper panel 32 may be about 36 inches tall and the middle strips **34*a* may be about 86 inches tall. The middle strips 34*a* may taper about 25%, from about 24 inches at the top side to about 18 inches at the bottom side. The end strips 34*b*** may have an interior side which tapers from about 24 inches at the top side to about 21 inches at the bottom side.

Figure 2:
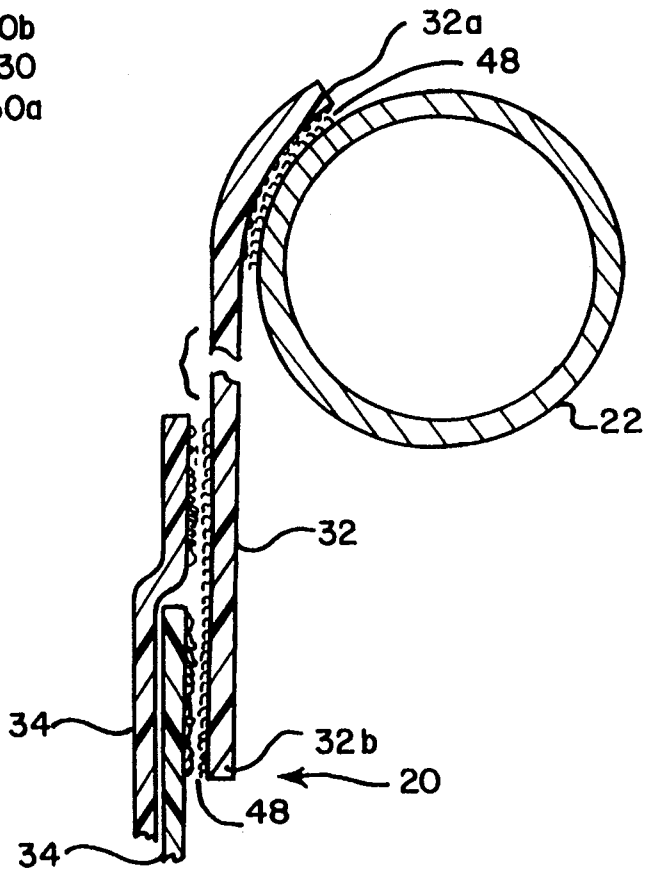
FIG. 2 is a cross section view of a support roller and the curtain member taken along line 2—2 in FIG. 1.

The top side **32*a* of the upper panel 32 may be attached to the support roller 22 using any suitable method although it is preferred that the upper panel 32 be releasably attached to the support roller 22 for ease of assembly and maintenance. One preferred attachment method is a hook and loop fastener 48 commonly referred to as a VELCRO fastener. The upper panel 32 may be attached to the roller 22 using other types of detachable fasteners including, for example, snap fasteners or the like or it may be fixedly attached to the support roller 22. FIG. 2 illustrates the upper panel 32 releasably attached to the support roller 32 using a hook and loop fastener 48. It has been found that a hook and loop fastener 48 having a width from about one to about two inches and disposed along the length of the support roller 22 is sufficient to support the curtain member 20** having the dimensions described above.

Similarly, the upper panels 32 and the lower strip panels 34 are preferably releasably attached together using hook and loop fasteners 48 or any other suitable fastening method. Referring to FIG. 2, it will be seen that lower end **32*b* of the upper panel 32 has one portion of the fastener 48 and the upper end of the lower strip panel 34 has the other portion of the fastener 48 which cooperate to attach the upper panel 32 and the lower strip panel 34 together. It has been found that a one to two inch wide fastener 48 disposed along the top side of each strip panel 34 is appropriate to support the lower strip panel 34. Upon reference to FIG. 2, it will be appreciated that the strip panels 34 forming the rear row 40 are disposed between the strip panels 34 forming the front row 42 and the upper panel 32 so as to permit the front row panels 34 to engage the fastener 48. The strip panels 34 may be attached on either side or both sides of the upper curtain 32. It will be appreciated the releasible nature of the individual strip panels permits ease of assembly and maintenance in the event that an individual strip panel 34 is damaged. Similarly, a portion or all of the strip panels 34 may be removed if an unobstructed door opening 12** is required or the weather permits.

Figure 3:
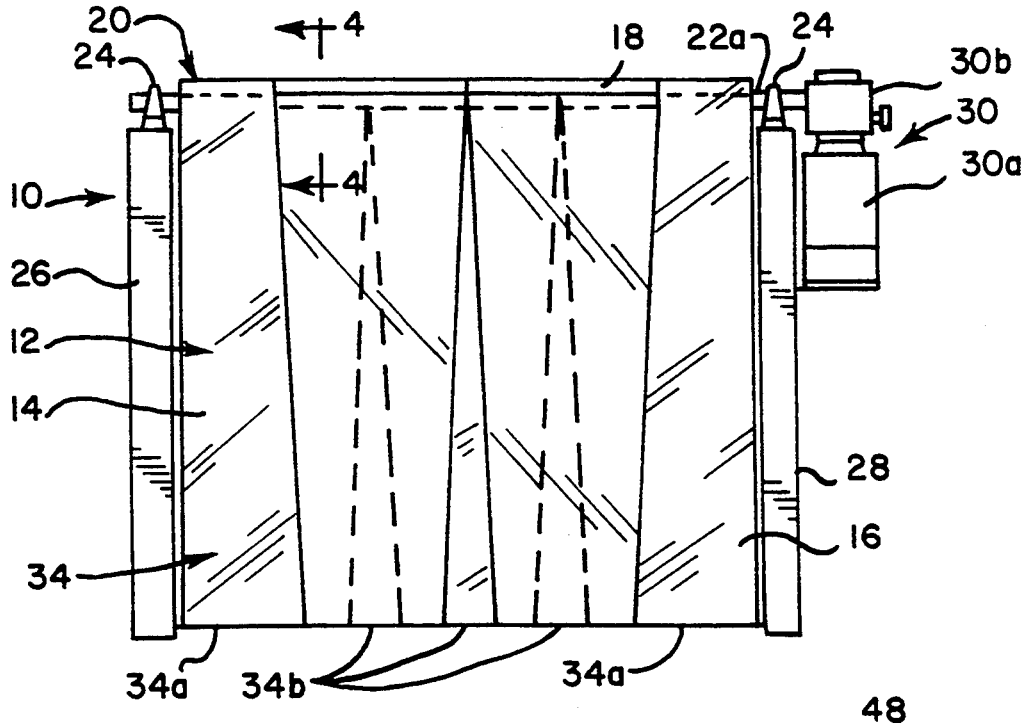
FIG. 3 is a front view of a second embodiment of the curtain barrier apparatus in accordance with the present invention.
Figure 4:
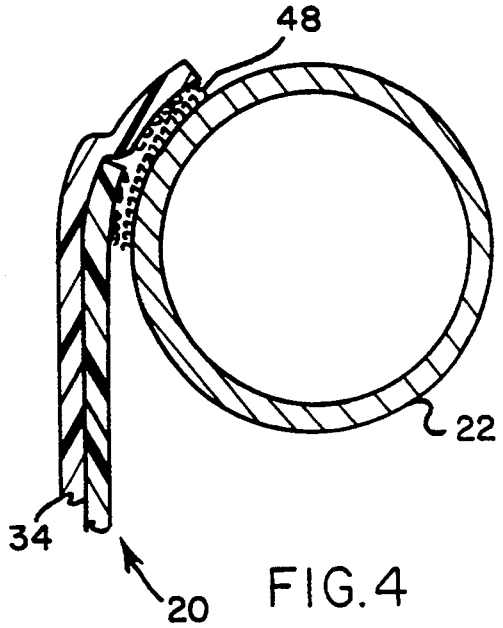
FIG. 4 a cross section view of the support roller and the curtain member taken along line 4—4 in FIG. 3.

In the embodiment illustrated in FIGS. 3–4, the door apparatus 10 comprises the plurality of strip panels 34 attached directly to the support roller 22 instead of the upper curtain panel 32 as described in the previous embodiment. The door apparatus illustrated in FIGS. 3–4 will otherwise operate the same as the previous embodiment.

It should now be appreciated the door apparatus 10 has two modes of operation. As explained previously, the curtain member 20 will typically be positioned in its closed position wherein the lower strip panels 34 form the seal across the door opening 12. Thus, the curtain 20 will provide a transparent barrier across the door 12 while permitting free passage of personnel therethrough. If it is desired to remove the hanging strip panels 34 such as, for example, for unobstructed ingress and egress or to prevent contact between the curtain member 20 and personal equipment or fragile material, the appropriate number of individual panels 34 may be detached from the apparatus 10 to form an appropriately large passage through door 12 while still providing some seal coverage about the door's periphery. In accordance with certain objects of the invention and another mode of operation, the curtain member 20 may also be positioned to its raised position by activating the support roller 22 and rolling the curtain member 20 about the roller 22 until the curtain member 20 is removed from the door opening.

Thus, it will be seen that a roller door apparatus 10 and related sealing devices have been provided which attain the aforenoted objects. Various additional modifications of the described embodiments of the invention specifically illustrated and described herein will be apparent to those skilled in the art, particularly in light of the teachings of this invention. Thus, while the preferred embodiments of the present invention have been disclosed, it will be appreciated that it is not limited thereto but may be otherwise embodied with the scope of the following claims.

We claim as our invention:

1. A barrier apparatus for sealing and creating a barrier across a door opening defined by opposing sides and a top side, the apparatus comprising:

a support roller rotatably mounted about the top side of the door opening, a flexible curtain member attached to the support roller and adapted to be rolled about the support roller in response rotation of the roller between a sealing position wherein the curtain member forms an air-blocking seal across the door opening and an open position wherein the curtain member is rolled about the support roller so as to present an unobstructed door opening, the curtain member having a plurality of unattached strip panels defined by top, bottom and opposing sides which span the door opening in adjacent relationship to each other to form the air-blocking seal across the door opening and which permit personnel and material to pass therethrough.

2. The apparatus as set forth in claim 1 wherein the strip panels are disposed in overlapping and abutting relationship to each other to form the air blocking seal.

3. The apparatus as set forth in claim 1 wherein the curtain member has a plurality of rows, each row formed by adjacent strip panels and the strip panels of one row overlap the strip panels of another row to form the air blocking seal.

4. The apparatus as set forth in claim 1 wherein the width of the strip panel becomes narrower from the top to the bottom of the strip panel.

5. The apparatus as set forth in claim 4 wherein the curtain member has a plurality of rows, each row formed by adjacent strip panels, the sides of adjacent strip panels defining a gap therebetween, and the strip panels of one row overlap the strip panels of another adjacent row so as cover the gaps of the one row to form the air blocking seal.

6. The apparatus as set forth in claim 1 wherein the strip panels are releasably attached to the support roller.

7. The apparatus as set forth in claim 6 wherein the strip panels are releasably attached to the support roller using a hook and loop fastener.

8. A barrier apparatus for sealing and creating a barrier across a door having opposing sides and a top side defining a door opening, the apparatus comprising:

a support roller rotatably mounted about the top side of the door, a flexible curtain member attached to the support roller and adapted to be rolled about the support roller in response rotation of the roller between a sealing position wherein the curtain member forms an air-blocking seal across the door opening and an open position wherein the curtain member is rolled about the support roller so as to present an unobstructed door opening, and the curtain member comprises an upper solid, flexible panel disposed across a top portion of the door opening and having a top side attached to the support roller and a bottom side attached to a plurality of strip panels defined by top, bottom and opposing sides which span a lower portion of the door opening in adjacent relationship to each other to form the air-blocking seal across the door opening and which permit personnel and material to pass therethrough.

9. The apparatus as set forth in claim 8 wherein the strip panels are disposed in overlapping and abutting relationship to each other to form the air blocking seal.

10. The apparatus as set forth in claim 8 wherein the curtain member has a plurality of rows, each row formed by adjacent strip panels and the strip panels of one row overlap the strip panels of another row to form the air blocking seal.

11. The apparatus as set forth in claim 8 wherein the width of the strip panel becomes narrower and tapers from the top to the bottom of the strip panel.

12. The apparatus as set forth in claim 11 wherein the curtain member has a plurality of rows, each row formed by adjacent strip panels, the sides of adjacent strip panels defining a gap therebetween, and the strip panels of one row overlap the strip panels of another adjacent row so as cover the gaps of the one row to form the air blocking seal.

13. The apparatus as set forth in claim 11 wherein the curtain member disposed along the opposing sides of the door has two or more strip panels in overlapping and abutting relation for support and reinforcement.

14. The apparatus as set forth in claim 8 wherein the strip panels are releasably attached to the upper panel.

15. The apparatus as set forth in claim 8 wherein the strip panels are releasably attached to the upper panel using a hook and loop fastener.

16. The apparatus as set forth in claim 8 wherein the upper panel is releasably attached to the support roller.

17. The apparatus as set forth in claim 8 wherein the upper panel is releasably attached to the support roller using a hook and loop fastener.

18. A barrier apparatus for partitioning a space, the apparatus comprising:

a frame rotatably supporting a support roller, a flexible curtain member attached to the support roller and adapted to be rolled about the support roller in response rotation of the roller between a barrier position wherein the curtain member forms a partition across the space and an open position wherein the curtain member is rolled about the support roller so as to present an unobstructed space, the curtain member having a plurality of unattached strip panels defined by top, bottom and opposing sides which span the space in adjacent relationship to each other to form the partition across the space and which permit personnel and material to pass therethrough.

19. The apparatus as set forth in claim 18 wherein the strip panels are disposed in overlapping and abutting relationship to each other to form the partition.

20. The apparatus as set forth in claim 18 wherein the curtain member has a plurality of rows, each row formed by adjacent strip panels and the strip panels of one row overlap the strip panels of another row to form the partition.

21. The apparatus as set forth in claim 18 wherein the width of strip panel becomes narrower from the top to the bottom of the strip panel.

22. The apparatus as set forth in claim 21 wherein the curtain member has a plurality of rows, each row formed by adjacent strip panels, the sides of adjacent strip panels defining a gap therebetween, and the strip panels of one row overlap the strip panels of another adjacent row so as cover the gaps of the one row to form the partition.

23. The apparatus as set forth in claim 18 wherein the strip panels are releasably attached to the support roller.

24. The apparatus as set forth in claim 18 wherein the strip panels are releasably attached to the support roller using a hook and loop fastener.

25. A barrier apparatus for partitioning a space, the apparatus comprising:

a frame rotatable mounting a support roller, a flexible curtain member attached to the support roller and adapted to be rolled about the support roller in response rotation of the roller between a barrier position wherein the curtain member forms a partition across the space and an open position wherein the curtain member is rolled about the support roller so as to present an unobstructed space, and the curtain member comprises an upper solid, flexible panel wherein the upper panel is disposed across a top portion of the space and has a top side attached to the support roller and a bottom side attached to a plurality of strip panels defined by top, bottom and opposing sides which span a lower portion of the space in adjacent relationship to each other to form the partition across the space and which permit personnel and material to pass therethrough.

26. The apparatus as set forth in claim 25 wherein the strip panels are disposed in overlapping and abutting relationship to each other to form the partition.

27. The apparatus as set forth in claim 25 wherein the curtain member has a plurality of rows, each row formed by adjacent strip panels and the strip panels of one row overlap the strip panels of another row to form the partition.

28. The apparatus as set forth in claim 27 wherein the curtain member disposed along the opposing sides of the door has two or more strip panels in overlapping and abutting relation for support and reinforcement.

29. The apparatus as set forth in claim 25 wherein the strip panels are releasably attached to the upper panel.

30. The apparatus as set forth in claim 25 wherein the strip panels are releasably attached to the upper panel using a hook and loop fastener.

31. The apparatus as set forth in claim 25 wherein the upper panel is releasably attached to the support roller.

32. The apparatus as set forth in claim 25 wherein the upper panel is releasably attached to the support roller using a hook and loop fastener.

33. A barrier apparatus for sealing and creating a barrier across a door opening defined by opposing sides and a top side, the apparatus comprising:

a support roller rotatably mounted about the top side of the door opening, a flexible curtain member attached to the support roller and adapted to be rolled about the support roller in response rotation of the roller between a sealing position wherein the curtain member forms an air-blocking seal across the door opening and an open position wherein the curtain member is rolled about the support roller so as to present an unobstructed door opening, the curtain member having a plurality of strip panels defined by top, bottom and opposing sides which span the door opening in adjacent relationship to each other to form the air-blocking seal across the door opening and which permit personnel and material to pass therethrough and wherein the width of the strip panel becomes narrower from the top to the bottom of the strip panel.

34. The apparatus as set forth in claim 33 wherein the curtain member has a plurality of rows, each row formed by adjacent strip panels, the sides of adjacent strip panels defining a gap therebetween, and the strip panels of one row overlap the strip panels of another adjacent row so as cover the gaps of the one row to form the air blocking seal.

* * * * *